United States Patent [19]

Rabinowitz

[11] Patent Number: 4,598,746

[45] Date of Patent: Jul. 8, 1986

[54] CARRYING CASE

[75] Inventor: Harold Rabinowitz, Midlothian, Va.

[73] Assignee: Nappe Babcock Co., Richmond, Va.

[21] Appl. No.: 717,830

[22] Filed: Mar. 29, 1985

[51] Int. Cl.[4] ..... A45C 11/20; B65D 1/40; B65D 1/48

[52] U.S. Cl. ..... 150/52 R; 150/52 F; 206/545; 383/110

[58] Field of Search ..... 190/125, 126, 127; 206/545; 383/110; 150/52 R, 52 F

[56] References Cited

U.S. PATENT DOCUMENTS

| | | | |
|---|---|---|---|
| 1,176,755 | 3/1916 | Heinrich | 206/315.1 X |
| 1,627,344 | 5/1927 | Scott | 150/52 F |
| 1,922,485 | 8/1933 | McKee | 150/52 F |
| 2,482,322 | 9/1949 | Cortese | 150/52 R X |
| 2,575,893 | 11/1951 | Seaman | 383/110 X |
| 3,031,121 | 4/1962 | Chase | 229/41 R X |
| 4,143,695 | 3/1979 | Hoehn | 150/52 R |

*Primary Examiner*—William Price
*Assistant Examiner*—Sue A. Weaver
*Attorney, Agent, or Firm*—Kenneth J. Hovet

[57] ABSTRACT

A soft-sided semi-rigid case with carrying strap and hinged cover. The sidewalls include inner stiffening material overlaid with insulative material. The assembly is enclosed and sealed with flexible plastic. A presealed bottom having an upraised cushion area comprising an inner stiffening member overlaid with insulative material and encased with flexible plastic is provided. The bottom includes a peripheral flange of plastic. The flange is sealed to the outer lower edge of the sidewall plastic. The cover includes an insert portion formed of insulative material and stiffening members. It also is enclosed and sealed with flexible plastic material.

12 Claims, 7 Drawing Figures

CARRYING CASE

BACKGROUND OF THE INVENTION

1. Field of the Invention

The present invention relates to carrying cases and, more particularly, to a unique sealed assembly of parts forming a watertight insulated carrying case.

2. Description of the Prior Art

The construction of soft-sided or semi-rigid carrying cases has been a labor intensive high-cost process. Sewing watertight seams for interior and exterior corners is difficult and requires much care and skill. Close monitoring of quality and conducting seam testing procedures result in additional costs.

To alleviate some of the above problems, heat sealing techniques evolved. Instead of gluing or sewing, adjoining edges of heat sealable plastics were fused together by heat or electromagnetic energy to form a watertight joint. This worked good for plastic layers being joined from one or two dimensions. Great difficulty was encountered, however, when three dimensional corner joints were connected and fused together. Plastic fold lines occurred allowing water leaks. Conplicated heating dies and fixtures were also required.

The problem was aggravated when multiple layers of plastic were being joined and/or when the plastic was covering irregular three dimensional structure. Further problems occurred when the structure itself was resilient.

All of the above frequently resulted in misalignment and missed edges during the heat fusing process. As a result, the seams would come apart and the entire case would have to be reconstructed. Missed interior seams were difficult to detect by quality control monitors. This, of course, resulted in sales of a defective product and subsequent consumer dissatisfaction.

SUMMARY OF THE INVENTION

The present invention provides an assembly of presealed parts which are, in turn, connected together to form a leakproof insulated carrying case. Use of a preformed sealed bottom eliminates the necessity of sealing interior joints and corners. A corner sidewall flange and bottom peripheral lip are easily accessible to plastic fusing apparatus. This allows formation of a secure lap joint. Plastic layers in the cover are likewise readily accessible and sealable at their periphery with the same heat sealing apparatus.

DESCRIPTION OF THE PREFERRED EMBODIMENTS

Figure 1:
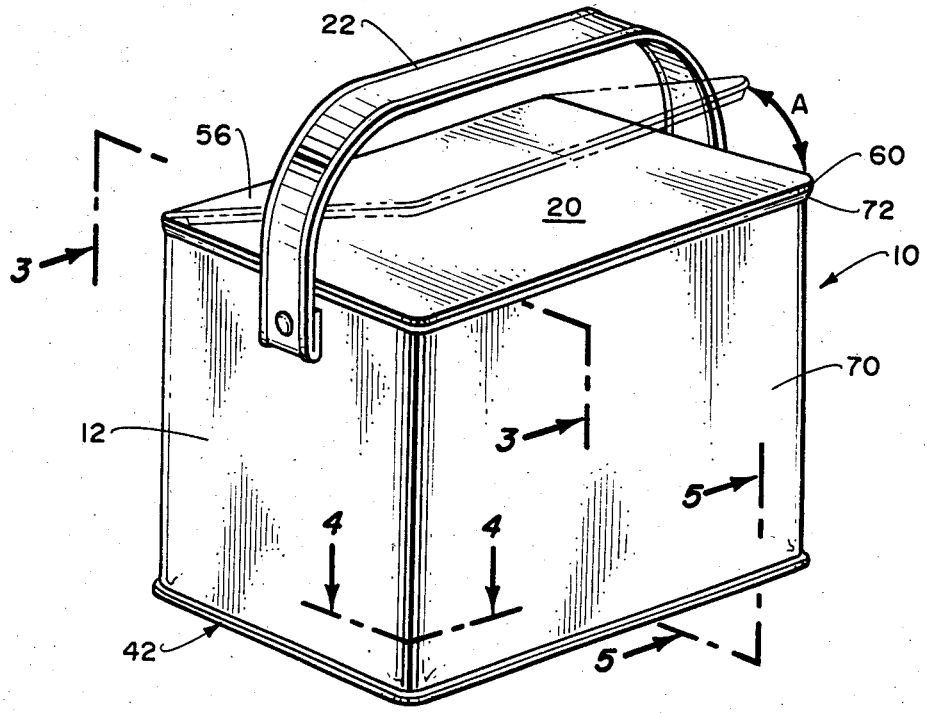
FIG. 1 is a perspective view of the carrying case of the present invention including a cover shown slightly raised in phantom.
Figure 2:
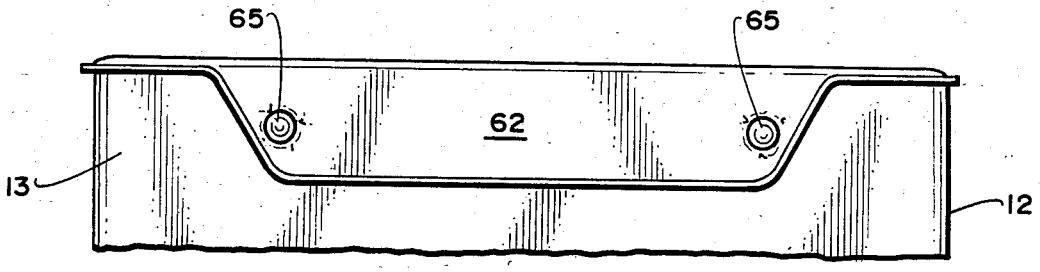
FIG. 2 is a fragmentary elevational view of the upper back portion of the case of FIG. 1.

With reference now to the drawings, FIG. 1 shows the carrying case (10) of the present invention. In plan view, the case can have a square, rectangular, oval or circular shape as dictated by consumer demand. The materials of construction are lightweight and allow the case to be easily carried manually. It is typically used as an insulated basket, cooler or hamper for food and drink items.

The case comprises an endless sidewall structure (12) having a bottom opening (14) defined by bottom end (15) and top opening (16) defined by top end (17). Overlying the bottom opening is bottom preform (18). Overlying the top opening is cover (20). The case may include carrying means shown as a strap (22) connected to opposing sides of the sidewall structure (12). Other carrying means known in the art may be used such as a loop strap, handles, braided cord or a pair of pivoted straps such as what is commonly found in picnic baskets.

The sidewalls are constructed of an inner support means (24) which may be panels of cardboard, stiff fiberboard or various types of resilient plastic materials. One or both sides of the support means may be covered with sidewall insulative material. As shown, this comprises an inner layer (26) and outer layer (28) which extends adjacent to and coextensive with the respective inner and outer surfaces of the support means. As used herein, insulative material comprises any one or combination of plastic foam materials such as Styrofoam, Ethafoam and polyurethane or fibrous mat material such as fiberglass and jute.

Completely encasing and enclosing the support means and insulative material is a layer of heat sealable plastic material (30). The ends of the plastic material are brought together at the lower outer peripheral corner of end (15) and fused together to form a flange shown by reference numeral (32). If two sheets of plastic (68) and (70) are used to encase the sidewalls, then a top joint (72) will be formed at the outer periphery of end (17). In such case, inner and outer side seams (not shown) will also be formed.

Overlying the bottom sidewall opening (14) is bottom preform (18). The overall planar shape of the preform corresponds to the outline of the sidewall structure and is defined primarily by reinforcement means (34). The reinforcement means comprises any of the same materials described for use with the support means (24). it extends to about the outer periphery of lower edge (15).

A thick upper insulative layer (36) is centered upon the reinforcement means. Its circumference is defined by the inside edge of lower end (15) thereby forming a ledge portion (19) about the upper outer periphery of the bottom preform. A thin insulative layer (37) may be used to cover the underside of the reinforcement means. This gives the bottom a softer look and feel.

The above parts are sealingly encased with a layer of plastic (38). Typically, the plastic will comprise upper and lower die-cut sheets with edges that overlap about the preform outer periphery. Such edges are readily accessible to heating apparatus which fuses the plastic to form a radially extending lip (40). As used herein, plastic material, sheet or layer includes any type of heat fusible plastic such as polyvinyl or polyvinyl chloride. The material should be flexible over a wide range of ambient temperatures. It should also be tear and stain resistant.

Figure 5:
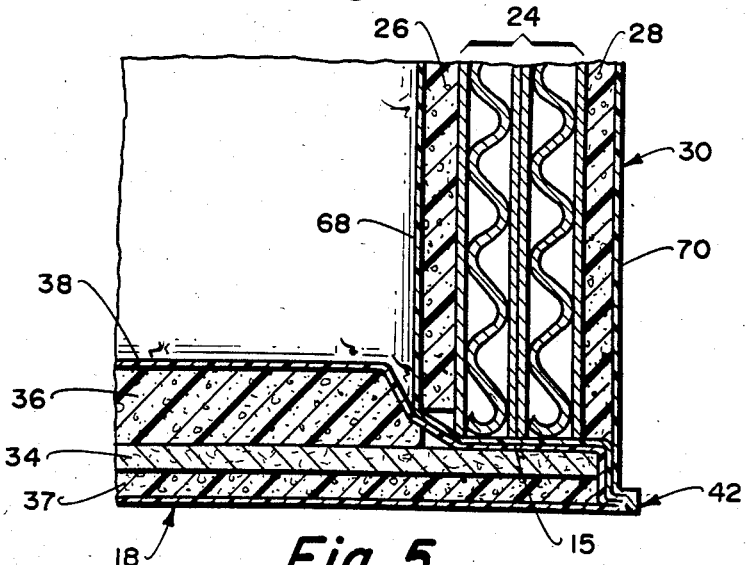
FIG. 5 is an enlarged fragmentary cross-sectional view taken along lines 5—5 of FIG. 1.
Figures 3, 4, 6, 7:
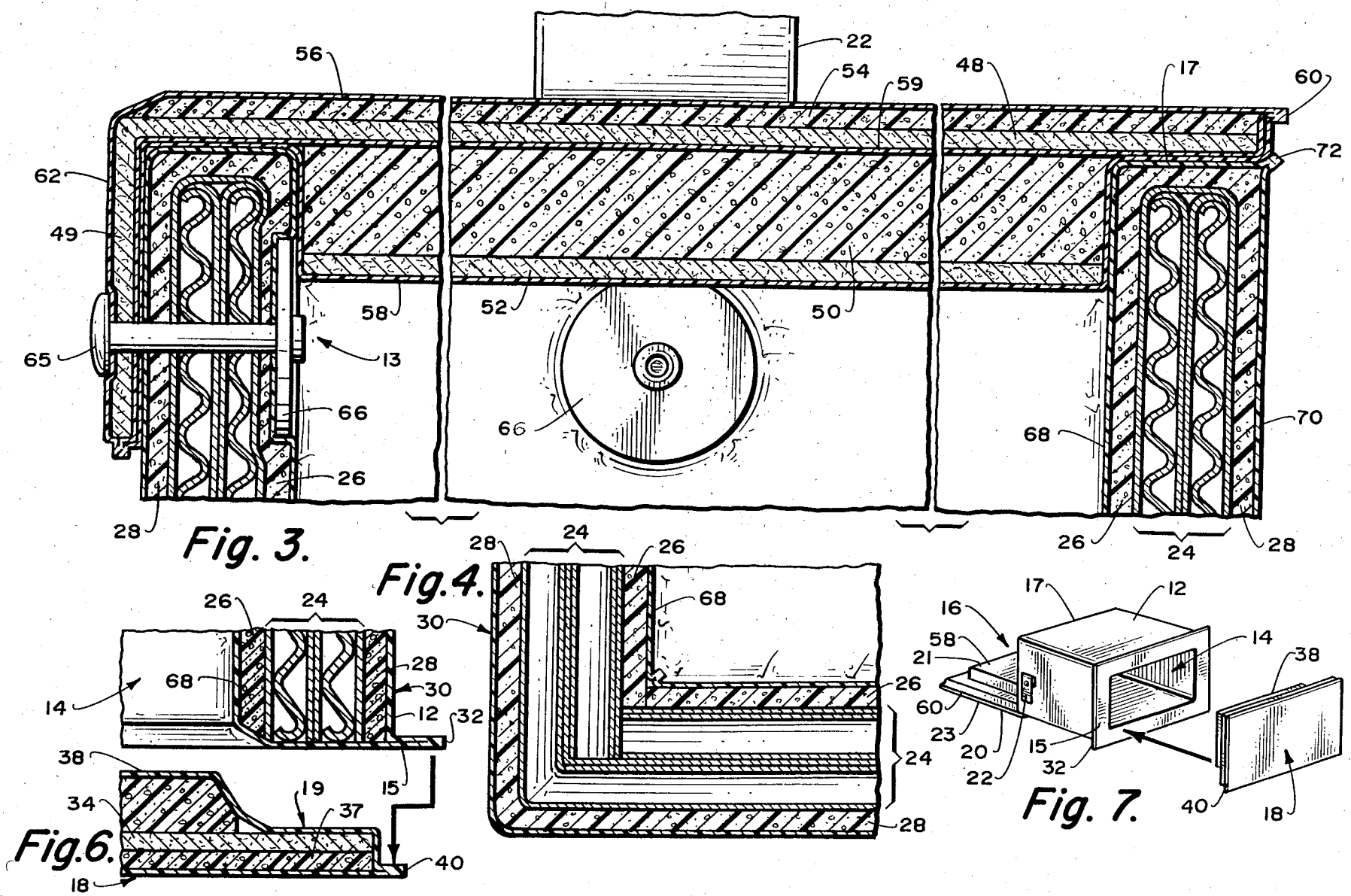
FIG. 3 is an enlarged fragmentary cross-sectional view taken along lines 3—3 of FIG. 1.
FIG. 4 is an enlarged fragmentary cross-sectional view taken along lines 4—4 of FIG. 1.
FIG. 6 is the same view as FIG. 5 except that the bottom preform is shown exploded from the sidewall lower edge.
FIG. 7 is an exploded bottom perspective view of the case of FIG. 1.

As best shown in FIGS. 5, 6 and 7 the bottom preform is positioned over opening (14) with the upper insulative layer (36) extending into the case interior. The ledge portion (19) will abut bottom end (15) with flange (32) and lip (40) overlapping. As before with formation of the flange and lip individually, a heating device is used to fuse the two edge parts together and form a lap joint (42). In this manner, four individual layers of heat sealable plastic are combined and fused into a solid watertight connection between the sidewall structure (12) and bottom preform (18).

With reference now to cover (20), its overall cross-sectional shape is similar to the bottom preform. It includes a first stiffening member (48) which is shaped to extend to about the outer edge of top end (17). If the cover is to be attached to the sidewall structure for rotation as shown by Arrow A, said stiffening member will include an extension (49) along a portion of one side thereof. Said portion extends from the aforementioned top end outer edge down along an upper region (13) of the sidewall structure. It may be secured thereto by means known in the art such as fusion, adhesion, sewing or mechanical means such as the headed pin (65) and washer (66) shown in the drawings. Any of the above may also be used to secure the ends of strap (22) to the sidewall structure.

Centered adjacent the underside of the first stiffening means is lower thickened insulative layer (50). Said layer is shaped to extend up to about the inner edge of top end (17) when the cover overlies opening (16). In such position, it will extend into the case interior in the same manner as the bottom insulative layer (36). A peripheral cover ledge (23) is also formed thereby allowing for an enhanced engagement and seal between the cover and sidewall structure.

A second stiffening member (52), which is coextensive with the insulative layer (50), is placed therebelow. This member serves to strengthen and protect the cover underside. Both members are made of any of the materials described for use as support or reinforcement means.

Above the first stiffening member is an upper thin layer of insulative material (54). This layer covers the upper surface and functions to cushion the top and soften the appearance.

The cover itself is enclosed and sealed about its periphery with an overlay of heat sealable plastic material. The overlay comprises an outer plastic sheet (56), an inner sheet (58) and an optional intermediate sheet (59). The intermediate sheet is used when the first stiffening member and upper insulative layer (54) are preassembled and sealed before the addition of the lower insulative layer (50) and second stiffening member. This permits the option of whether or not to include the insert portion (21) with the cover.

The edges of the above die-cut sheets are fused together to form cover joint (60) adjacent the periphery of first stiffening member (48). The plastic will also sealingly enclose extension (49) to form the cover hinge portion (62).

With the carrying case as above described, it can be seen that the cover, bottom preform and sidewall structure are each individually fully encased and sealed. The bottom preform is simply and effectively secured in a watertight sealed manner to a preformed sidewall flange. As so assembled, a unique carrying case is provided which is economical to manufacture, lightweight, durable and watertight. It is easy to handle and clean and has great utility as a low-cost insulated food and beverage carrier.

While the invention has been described with respect to a preferred embodiment, it will be apparent to those skilled in the art that other modifications and improvements may be made without departing from the scope and spirit of the invention. Accordingly, it is to be understood that the invention is not to be limited by the specific illustrative embodiments, but only by the scope of the appended claims.

I claim:

1. A carrying case comprising:

an endless sidewall structure having a top opening and a bottom opening consisting of an inner support means defining the three dimensional shape of said case, sidewall insulative material coextensive with and adjacent to said support means and a layer of heat sealable sidewall plastic material enclosing both said support means and said insulative material forming a flange about the outer peripheral edge of said bottom opening;

a bottom preform overlying said bottom opening consisting of reinforcement means defining the planar shape of said preform in correspondence with the bottom opening of said case, bottom insulative material adjacent said reinforcement means and, a layer of heat sealable bottom preform plastic material enclosing both said reinforcement means and said insulative material having an outwardly extending peripheral lip, said flange and lip forming a heat sealed lap joint that connects the bottom preform to said sidewall structure;

a cover overlying said top opening consisting of a first stiffening member defining the planar shape thereof in correspondence with said top opening, cover insulative material adjacent to said stiffening member including a lower thickened layer extending from said first stiffening member into the interior area of said case with a second stiffening member adjacent the underside of said lower thickened layer and an intermediate layer of heat sealable plastic material interposed between said first stiffening member and said lower thickened layer of insulative material and, a layer of heat sealable cover plastic material enclosing both of said stiffening members and said insulative material.

2. The case of claim 1 wherein said cover includes a hinge portion that extends beyond the planar shape thereof and is attached to an upper region of said sidewall structure.

3. The case of claim 1 wherein said bottom insulative material includes an upper thickened layer extending from said reinforcement means into the interior area of said case.

4. The case of claim 1 wherein said cover insulative material includes an upper thin layer over the upper surface of said first stiffening member.

5. The case of claim 3 wherein said insulative material includes a lower thin layer underlying said reinforcement means.

6. The case of claim 1 wherein said sidewall insulative material comprises a layer adjacent inner and outer surfaces of the support means.

7. The case of claim 1 wherein said layer of sidewall plastic material comprises an inner sheet and outer sheet adjacent respective sides of said support means joined together at said flange and at a top joint about the upper edge of said sidewall structure.

8. The case of claim 1 including carrying means connected thereto for manually handling said case.

9. The case of claim 8 wherein said intermediate layer and layer of cover plastic material are joined about the peripheral edge of said cover.

10. The case of claim 8 wherein said carrying means comprises a strap secured to opposing sides of said sidewall structure.

11. The case of claim 3 wherein the periphery of said upper thickened layer is inwardly offset from the periphery of said reinforcement means forming a ledge portion around the bottom preform.

12. The case of claim 1 wherein the periphery of said lower thickened layer is inwardly offset from the periphery of said first stiffening member forming a cover ledge around said cover.

* * * * *